US011813509B1

(12) United States Patent
Reynolds et al.

(10) Patent No.: US 11,813,509 B1
(45) Date of Patent: Nov. 14, 2023

(54) HELMET COVER FOR USE AS A TRAINING AID

(71) Applicants: Timothy J Reynolds, Ithaca, NY (US); John J Winslow, Lansing, NY (US); Lavell D Williams, Clinton, MS (US); James E Strait, Lansing, NY (US)

(72) Inventors: Timothy J Reynolds, Ithaca, NY (US); John J Winslow, Lansing, NY (US); Lavell D Williams, Clinton, MS (US); James E Strait, Lansing, NY (US)

( * ) Notice: Subject to any disclaimer, the term of this patent is extended or adjusted under 35 U.S.C. 154(b) by 0 days.

(21) Appl. No.: 15/917,653

(22) Filed: Mar. 11, 2018

Related U.S. Application Data

(60) Provisional application No. 62/599,206, filed on Dec. 15, 2017.

(51) Int. Cl.

| | |
|---|---|
| ***A63B 69/00*** | (2006.01) |
| ***A42B 3/04*** | (2006.01) |
| ***A63B 102/14*** | (2015.01) |
| ***A63B 102/22*** | (2015.01) |
| ***A63B 102/24*** | (2015.01) |

(52) U.S. Cl.
CPC ..... *A63B 69/002* (2013.01); *A42B 3/0406* (2013.01); *A63B 69/00* (2013.01); *A63B 69/0024* (2013.01); *A63B 2102/14* (2015.10); *A63B 2102/22* (2015.10); *A63B 2102/24* (2015.10); *A63B 2243/007* (2013.01)

(58) Field of Classification Search
CPC ..... A63B 69/002; A63B 69/00; A63B 69/345; A63B 69/0059; A63B 69/0024; A63B 2243/0025; A63B 2243/007; A63B 2102/14; A63B 2102/22; A63B 2102/24; A42B 3/406
See application file for complete search history.

(56) References Cited

U.S. PATENT DOCUMENTS 1,200,528 A * 10/1916 Ryder ..... A42B 1/045 2/203
1,615,780 A * 1/1927 Wesala ..... A42B 1/18 2/46
2,143,483 A * 1/1939 Iglauer ..... A42B 1/08 2/411
2,218,947 A * 10/1940 Brunzell ..... A42B 1/0181 D2/882
2,385,405 A * 9/1945 Crowther ..... A61F 9/025 2/12
2,435,688 A * 2/1948 Lupo ..... A42B 7/00 2/207
3,155,981 A * 11/1964 McKissick ..... A42B 3/003 2/422

(Continued)

FOREIGN PATENT DOCUMENTS

CA 2308086 A1 * 11/2001 ..... A42B 3/22

*Primary Examiner* — Melba Bumgarner
*Assistant Examiner* — Amir A Klayman

(57) ABSTRACT

An apparatus and a method that provides a helmet cap with an embedded visor on the inside of said helmet cap to train a wearer of a football helmet to correctly position the head in an up position when tacking and blocking during sports play. The cap can be detachably but securely attached to a football helmet and upper facemask in a position where it does obstruct the view of the helmet wearer to a position where it does obstruct the helmet wearer's view and thus forces the helmet wearer to look up.

12 Claims, 15 Drawing Sheets

(56) References Cited

U.S. PATENT DOCUMENTS 3,245,087 A * 4/1966 Marchello ..... A42B 3/003 2/422
3,341,201 A * 9/1967 Ryan ..... A63B 59/00 473/518
3,435,460 A * 4/1969 Grant ..... A42B 3/06 2/422
3,436,760 A * 4/1969 Molitoris ..... A42B 3/105 2/6.6
3,628,794 A * 12/1971 Conture ..... A63B 65/127 273/337
3,780,379 A * 12/1973 Kampman ..... A61F 9/04 2/15
4,022,466 A * 5/1977 Kaiser ..... A42B 3/20 473/446
4,096,589 A * 6/1978 Goldstein ..... A61F 9/045 2/12
4,303,241 A * 12/1981 Burroughs ..... A63B 69/0053 473/458
4,393,519 A * 7/1983 Nicastro ..... A42C 5/02 2/12
4,495,657 A 1/1985 Bay
4,605,226 A * 8/1986 Morrissey ..... A63B 69/0024 D29/109
4,644,588 A * 2/1987 Zawacki ..... A61F 9/04 128/858
4,660,230 A * 4/1987 Mayling ..... A42B 3/069 2/413
4,776,042 A * 10/1988 Hanson ..... A42B 1/008 2/909
4,811,430 A * 3/1989 Janusz ..... A41D 20/00 2/171
4,852,189 A * 8/1989 Duggan ..... A41D 20/00 2/452
4,918,758 A * 4/1990 Rendina ..... G09F 7/12 2/919
4,947,488 A * 8/1990 Ashinoff ..... A42B 3/00 2/181
4,999,856 A 3/1991 DuVail
5,003,640 A * 4/1991 Pizzacar ..... A42B 1/248 40/329
5,062,163 A * 11/1991 Avey ..... A42B 1/067 2/410
5,123,116 A 6/1992 Roth
5,177,810 A 1/1993 Minto et al.
5,287,559 A * 2/1994 Christiansen ..... A42B 1/248 2/209.13
5,333,328 A * 8/1994 Roberts ..... A42B 3/227 2/12
5,373,857 A * 12/1994 Travers ..... G01C 17/30 600/595
5,481,759 A * 1/1996 Rinaldi ..... A42B 1/061 2/171.1
5,553,325 A * 9/1996 Gutierrez ..... A42B 1/0184 2/171.03
5,649,721 A * 7/1997 Stafford ..... B60R 21/04 244/118.5
5,661,854 A * 9/1997 March, II ..... A42B 3/00 2/410
D385,661 S * 10/1997 Moorhouse ..... D29/104
5,689,830 A * 11/1997 Pflum ..... A42B 1/0185 2/10
5,815,832 A * 10/1998 Skolik ..... A42B 3/185 2/10
5,832,541 A * 11/1998 Rock ..... A42B 3/20 2/424
5,857,220 A * 1/1999 Erny ..... A42B 1/248 2/244
5,882,205 A * 3/1999 Peterson ..... A42B 1/08 2/425
5,901,370 A * 5/1999 Linday ..... A42B 1/205 2/10
5,918,316 A * 7/1999 Nathanson ..... G09F 21/02 2/244
5,963,989 A * 10/1999 Robertson ..... A41D 20/00 2/171
6,081,933 A * 7/2000 Partsch, IV ..... A42B 3/227 2/195.1
6,151,719 A 11/2000 Poole
6,237,162 B1 * 5/2001 Gill ..... A42B 3/003 2/10
6,374,423 B1 * 4/2002 Anderson ..... A42B 3/227 2/12
6,397,399 B1 * 6/2002 Lampe ..... A42B 1/008 2/171.2
6,463,592 B1 * 10/2002 Brooks ..... A42B 1/04 2/209.12
6,622,309 B1 * 9/2003 Edmonds ..... A63B 69/0071 2/15
6,826,784 B2 12/2004 Patrie
6,976,272 B2 12/2005 Kyzysik, Jr. et al.
7,649,700 B1 1/2010 Diemer
7,690,052 B2 * 4/2010 Saladino ..... A42B 1/247 2/173
D625,084 S * 10/2010 Plekker ..... D2/894
8,020,218 B2 * 9/2011 Stingone ..... A42B 1/0185 2/209.12
8,051,500 B2 11/2011 Lee et al.
8,104,891 B2 1/2012 Reichow et al.
8,381,317 B2 2/2013 Tipp
8,387,169 B2 3/2013 Shockman
8,776,272 B1 * 7/2014 Straus ..... A42B 3/003 2/411
9,060,558 B2 * 6/2015 Dorman ..... G09F 21/026
9,192,203 B2 * 11/2015 Perthou ..... A42B 1/041
9,439,468 B1 * 9/2016 Blagg ..... A42B 3/064
9,451,801 B2 * 9/2016 Bryan ..... A42B 3/044
9,586,116 B2 * 3/2017 Churchman ..... A63B 71/0622
9,603,402 B2 * 3/2017 Warner ..... A63F 9/001
9,943,746 B2 * 4/2018 Kennard ..... A42B 3/064
10,293,205 B2 * 5/2019 Perkins ..... A61B 5/6803
10,376,012 B2 * 8/2019 Sakemiller ..... A42B 3/227
10,702,757 B2 * 7/2020 Connell ..... G08C 17/02
10,751,592 B1 * 8/2020 Roberts ..... A42B 3/0406
2002/0004946 A1 * 1/2002 Nelson ..... A42B 3/003 2/195.3
2002/0144334 A1 * 10/2002 Brooks ..... A42B 1/206 2/209.12
2002/0189004 A1 * 12/2002 Aaron ..... A42B 1/08 2/411
2004/0163162 A1 * 8/2004 Benziger ..... A63B 21/4003 2/411
2004/0250341 A1 * 12/2004 Lambert ..... A42B 1/08 2/425
2006/0240915 A1 * 10/2006 Hohl ..... A63B 69/0071 473/447
2007/0250992 A1 * 11/2007 Brown ..... A42B 3/20 2/424
2011/0167544 A1 * 7/2011 Kim ..... A42B 3/227 2/171.2
2011/0252545 A1 * 10/2011 Irrgang ..... A42B 3/003 428/44
2011/0296593 A1 * 12/2011 Dhillon ..... A42B 3/003 2/410
2012/0157243 A1 * 6/2012 Gallo ..... A63B 69/0002 473/438
2012/0210491 A1 * 8/2012 Bryan ..... A42B 3/0406 2/181.4
2012/0236544 A1 * 9/2012 Dorman ..... A42B 3/0406 362/106
2013/0283504 A1 * 10/2013 Harris ..... A42B 3/127 2/411
2013/0340149 A1 * 12/2013 Richwine ..... A42B 3/003 2/422
2015/0051024 A1 * 2/2015 Churchman ..... A63B 71/0622 473/438
2016/0302500 A1 * 10/2016 Johnston ..... A41D 13/05

(56) References Cited

U.S. PATENT DOCUMENTS

| | | | | |
|---|---|---|---|---|
| 2016/0346140 | A1* | 12/2016 | Field | A61F 13/58 |
| 2019/0118057 | A1* | 4/2019 | Winter | A63B 69/00 |
| 2020/0001164 | A1* | 1/2020 | Jensen | A42B 3/124 |

* cited by examiner

301

Instructions for Use of the Cap

1. Position the Cap on a protective helmet during use of the helmet in a non-view obstructing position.
2. Move the Cap to a view obstructing position to teach the wearer to keep his or her head up when blocking or tackling.

*FIG. 29*

HELMET COVER FOR USE AS A TRAINING AID

CROSS-REFERENCE TO RELATED APPLICATIONS

This application claims the benefit of priority under applicable US laws of U.S. Provisional Application Ser. No. 62/599,206 filed on Dec. 15, 2017 the content of which is relied upon and incorporated herein by reference in its entirety.

TECHNICAL FIELD

The present disclosure is in the field of sports equipment related to attachments/accessories for use with football helmets. More particularly, this application relates to a device for training purposes for use with football helmets to promote proper head orientation during tacking and blocking.

BACKGROUND

Head injuries in sports pose a significant problem. In particular, they are significant in contact sports such as football. Even though participants in this sport wear protective helmets, head injuries are still a significant problem. One of the ways to avoid and prevent such injuries involves teaching the athletes to keep their head up and avoid, if possible, running head first, and not looking up and thus hitting an opponent's helmet or body first with the top or crown of their own helmet. One example of attempts to teach athletes to keep their heads up and avoid taking the major impact on contact with their helmet is a program provided by USA Football at its website "https://web.usa-football.com/film-room/tackle-progression.

FIG. 1 is a drawing of a fully suited up football player 31 approaching a tackling bag 33 with the wrong head and eye orientation. Football player 31 is approaching tackling bag 33 at a run. His helmeted head 35 is face down with his eyes, and field of view indicated by arrow 37. Given the fact that his helmeted head 35 and field of view is facing down 37, he cannot see the tackling bag 33. Thus, with the towered helmeted head 35 as depicted player 31 has the potential of hitting the tackling bag 33 with his helmet first, in particular the crown 39 first. This would result in axial loading of the crown of the helmet and consequently could result in a head or neck injury.

The USA Football's Heads Up program teaches the proper way for the player to approach a tackling bag 33 or an opponent they intended to block or tackle during practice or during a game on the field. The football player must approach the object he or she intends to block with appropriate head, neck and torso alignment to allow for a sufficient view of the opponent or object intended to be tackled or blocked. This allows the player to make contact with the shoulder, forearms, etc. and not the helmet, in particular the crown of the helmet.

No admission is made that any reference cited herein constitutes prior art. Applicant expressly reserves the right to challenge the accuracy and pertinence of any cited documents.

SUMMARY

An aspect of the present subject matter is directed to a football helmet cover for use as a tackling training aid comprising: a removable textile material, which may or may not have elastic properties, that conforms to the external portion of a football helmet and extends over a portion of the facemask.

Another aspect of the present subject matter is directed to a football helmet cover for use as a tackling training aid comprising: a removable textile material, which may or may not have elastic properties, that conforms to the external portion of a football helmet and extends over a portion of the facemask; a semicircular or similarly shaped insert manufactured from a rubber, plastic, polyethylene, polypropylene or similar material embedded in a pocket found in the inside front portion of the helmet cover whereas the visor would be closest to the facemask, and the insert in the pocket will contact the upper portion of the facemask.

To achieve the various objectives of the present invention disclosed is vision obstruction cap for use with a football helmet to induce proper head and eye orientation during use of the football helmet including: a) a pliable cap that can be detachably but securely attached to a football helmet and upper facemask, b) wherein when said pliable cap is attached to the football helmet and upper facemask said cap can be moved between a position: (i) that obstructs a helmet wearer's vision to thereby force the helmet wearer to properly position the helmet wearer's head; and (ii) that does not obstruct the helmet wearer's vision.

The invention also provides a method for training a wearer of a football helmet to properly orientate the wearer's head during use of the football helmet consisting of the steps of: (a) providing a pliable cap that can be detachably but securely attached to a football helmet and upper facemask; (b) positioning the cap securely but detachably on the helmet and upper facemask in a position that the cap does not obstruct the view of the helmet wearer; and (c) moving the cap during practice to a position that obstructs the helmet wearer's view to thereby force the helmet wearers to raise his or her head to a proper position.

The invention also provides a combination article of manufacture consisting of: (a) a pliable cap: sized to fit detachably but securely over a football helmet; (b) labeling providing instructions found on the interior of the cap for use of said cap by: (i) positioning said cap on a football helmet and upper facemask during use of the helmet by a player in a non-view obstructing position; and (ii) moving the cap to a view obstructing position for training purposes to teach the wearer to keep his or her head up.

Additional features and advantages will be set forth in the detailed description which follows, and in part wilt be readily apparent to those skilled in the art from the description or recognized by practicing the embodiments as described in the written description and claims hereof, as well as the appended drawings:

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

BRIEF DESCRIPTION OF THE DRAWINGS

FIG. 29 is an example of labeling with instructions for use of the eye screen training cap.

DETAILED DESCRIPTION

Various embodiments will be further clarified by the following examples.

Figure 1:
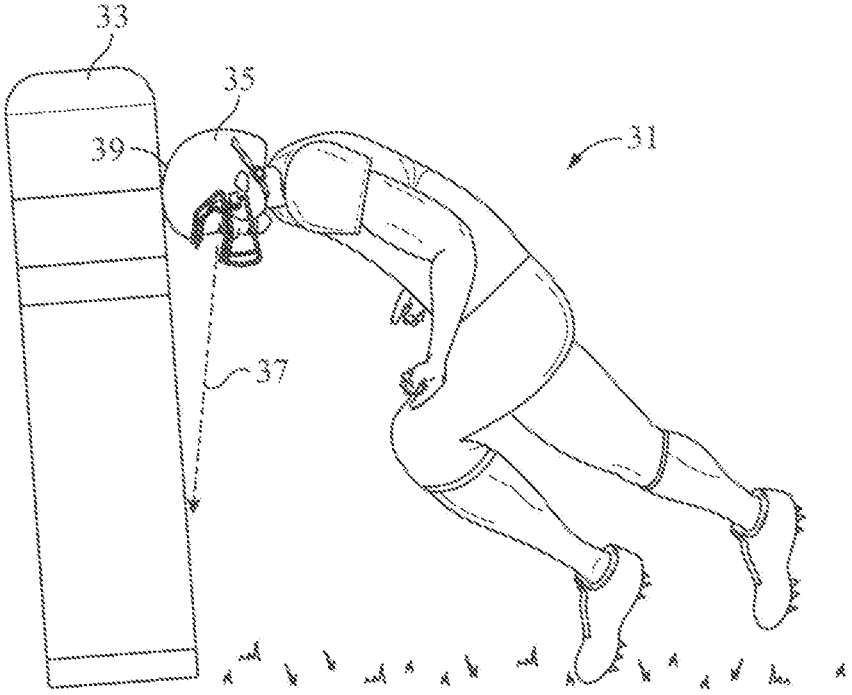
FIG. 1 (Prior Art)
FIG. 1 depicts a fully suited football player approaching a tackling bag with the wrong helmet and eye orientation.
Figure 2:
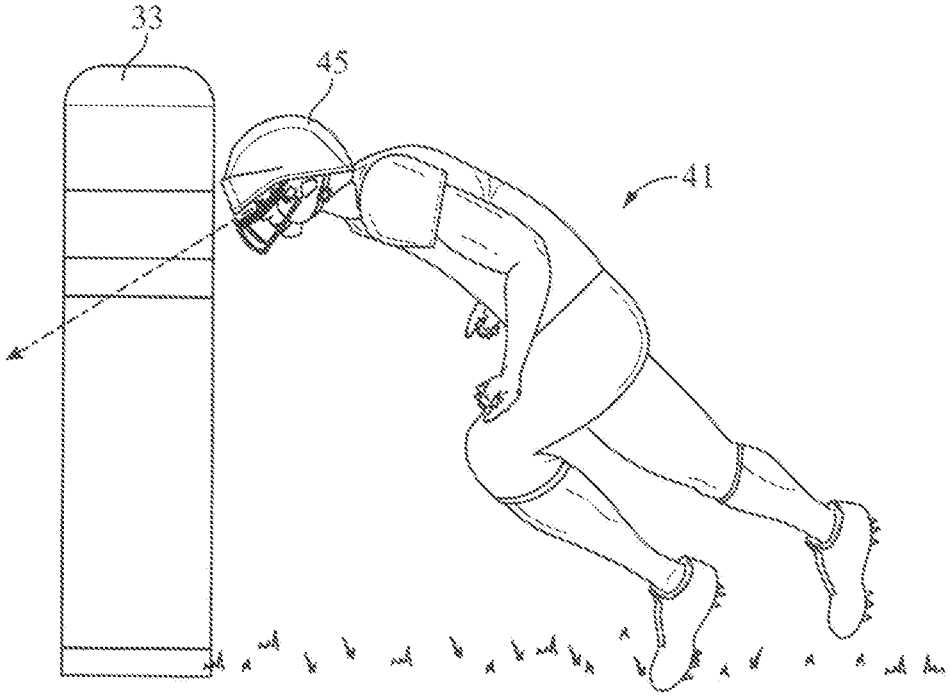
FIG. 2 depicts a football player approaching a tackling bag with the correct head and eye orientation when using the present invention.

FIG. 2 provides a view of a football player 41 approaching the tackling bag 33 with the correct head and eye orientation. In FIG. 2, player 41 has on his helmeted head 45 helmet cover 51 of the present invention. Cover 51 is in the down or restricted view position so that it reinforces the player's need to look up. In this position the player is forced to position his head and thus line of sight and along arrow 47. Thus, with the field of view of player 41 oriented along arrow 47 he is being trained and conditioned to orient his head and field of view to see what he is heading for. Thus, player 41 can see tackling bag 33 as he approaches it and makes the necessary adjustments of his head to avoid hitting the tackling bag 33 with his head and helmet but rather his shoulder or forearm in the correct and safe fashion. This training carries over to actual play where the player develops the habit of keeping his head up. The helmet cover of the present invention is referred to in various ways such as vision obstruction cap, cover, eye screen cap, stretchable cover, etc. throughout this specification.

Figure 3:
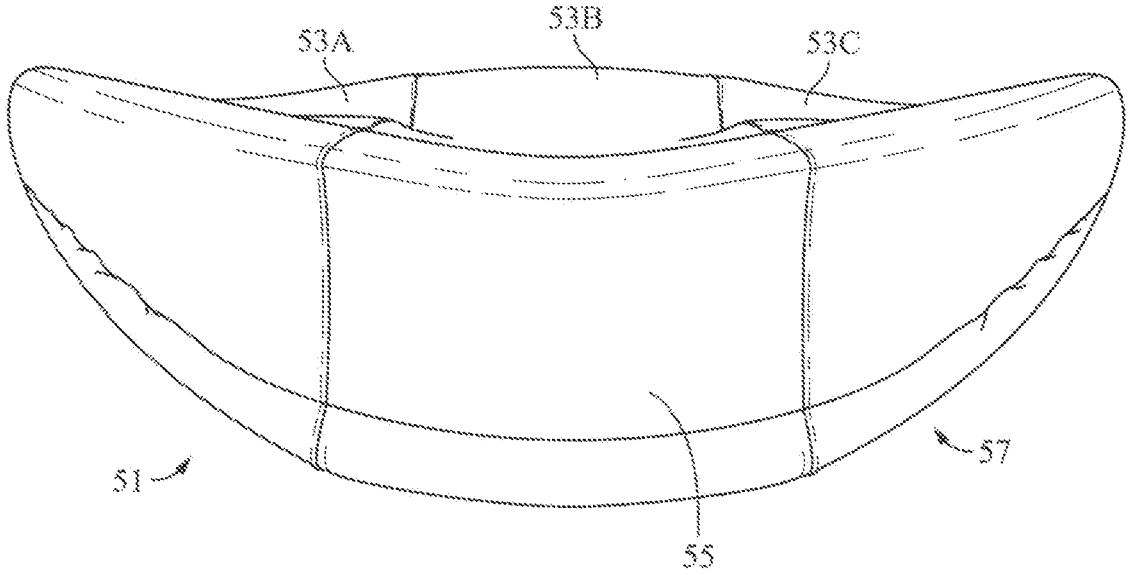
FIG. 3 is a front view of n embodiment of the helmet cover.

FIG. 3 is a front view of one exemplary embodiment of the helmet cover 51. The depicted helmet cover is three stitched together pieces of fabric 53A, 53B, and 53C. The front portion 55 has a visor insert 57 sewn in or positioned in a pocket made to hold the insert. The pocket is on the inside aspect of the helmet cover which is closest to the facemask, whereas the insert in the pocket will contact the upper portion of the facemask.

Figure 3A:
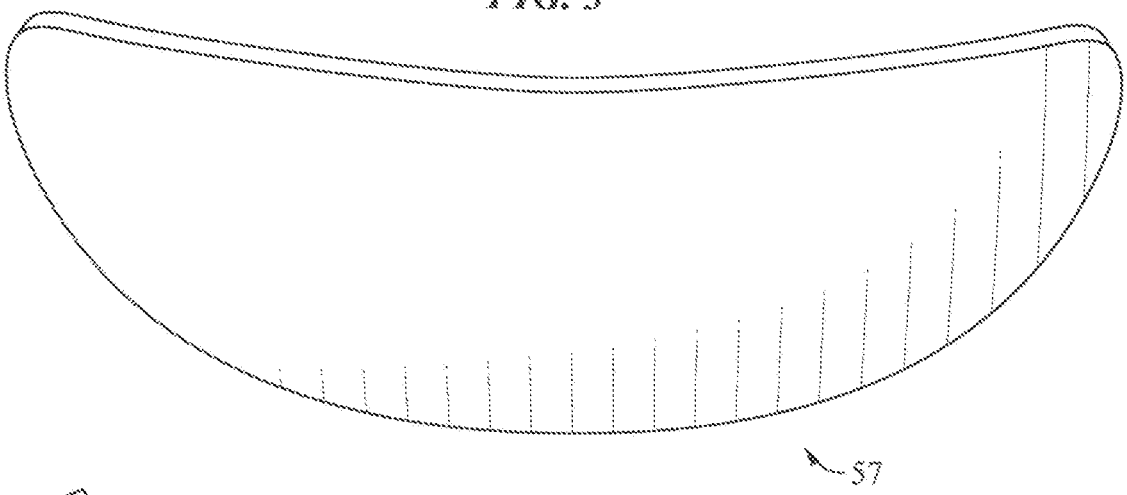
FIG. 3A is a front view of the visor insert removed from the helmet cover in FIG. 3.
Figure 3B:
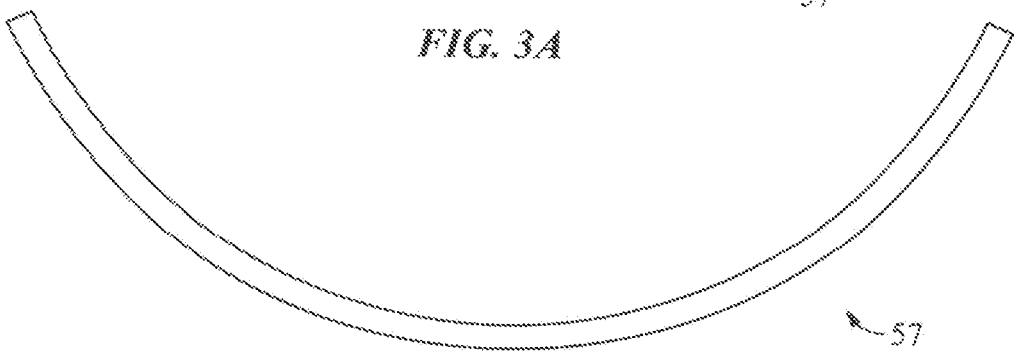
FIG. 3B is a top view of the visor insert of FIG. 3A.

FIG. 3A provides a front perspective view of visor 57. FIG. 3B is a top view of Visor 57. Visor insert 57 is made of a pliable flexible and formable material. Among the materials that could be used include plastic, rubber, polyethylene, polycarbonate, polypropylene or a similar type of material that is rigid but also flexible and durable. The visor or visor insert can be made from a pliable but rigid and durable material including but not limited to the following: plastic, polypropylene, silicon and rubber or similar material.

Figure 4:
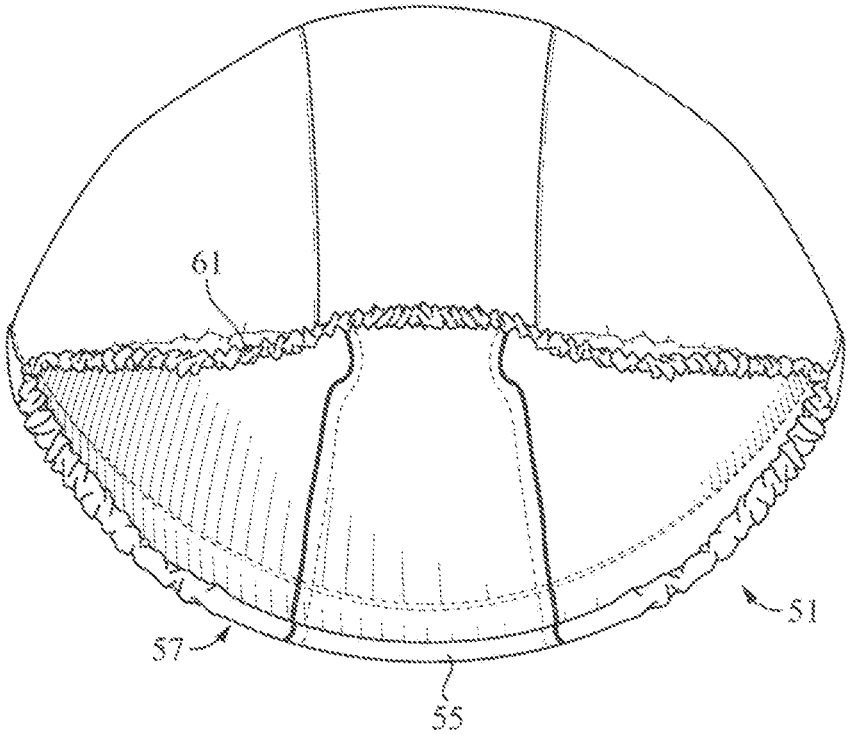
FIG. 4 is a bottom view of an embodiment of the helmet cover of FIG. 3.

FIG. 4 is a bottom view of helmet cover 51. Visor insert 57 sewn into cover 51 is at the inside front 55. In a circle around the peripheral edge of helmet cover 51 an elastic band 61 has been sewn to hold helmet cover 51 in place while attached to the helmet and upper facemask. The cover can be made of nylon or any similar material that can endure stretching on a regular basis without losing its shape. Additionally, although helmet cover 51 as depicted is made from three sections of material it could just as easily be made from one piece of fabric or material. Other alternative materials that could be used to fabricate the helmet cover include spandex or similar stretchable but durable material.

Figure 5:
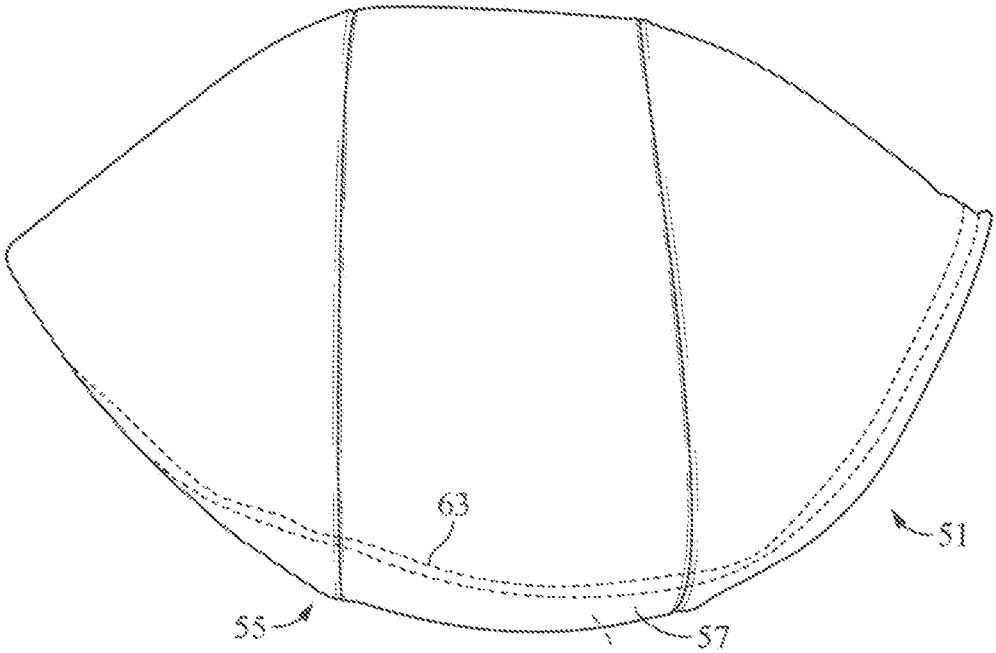
FIG. 5 is a op view of the embodiment of the helmet cover in FIG. 3.

FIG. 5 is a top view of helmet cover 51. The three sewn together sections 53A, 53B, and 53C can be seen. Also the outline of visor insert 57 sewn into cap 51 can be seen at the front 55. Stitch line 63 indicates where visor insert 57 has been sewn into a pocket 67 of cover 51. In the embodiment of cover cap 51 depicted in FIG. 5 visor insert 57 extends in almost a semi-circle around the entire front 55 of cover 51. Instead of sewing visor insert 57 into helmet cover 51, a pocket could be created in cover 51 which would allow visor insert to be inserted or removed as desired. Also the outline of visor insert 57 sewn into inside front of cap 51 can be seen at the front 55. Stitch line 63 indicates where visor insert 57 has been sewn into a pocket 67 of cover 51 found on the inside front of cover 51. In the embodiment of cover cap 51 depicted in FIG. 5 visor insert 57 extends in almost a semi-circle around the entire inside front 55 of cover 51. Instead of sewing visor insert 57 into helmet cover 51, a pocket could be created in the inside front cover 51 which would allow visor insert to be inserted or removed as desired.

Figure 6:
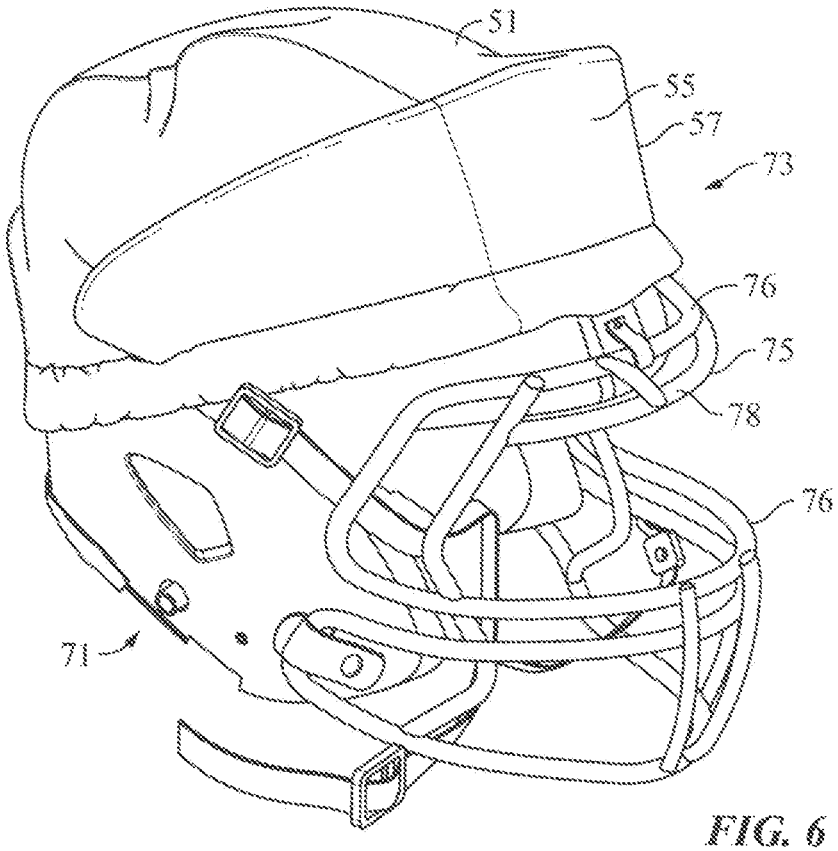
FIG. 6 is an, embodiment of the protective helmet cover positioned on a football helmet with the cover in the up or un-deployed position.

FIG. 6 is a shown helmet cover 51 placed on a football helmet 71 in the up or not in use position 73. In this position front 55 or visor insert 57 is positioned above face mask 75. As can be seen helmet cover 51 does not obscure the view of a person wearing the helmet 71.

Figure 7:
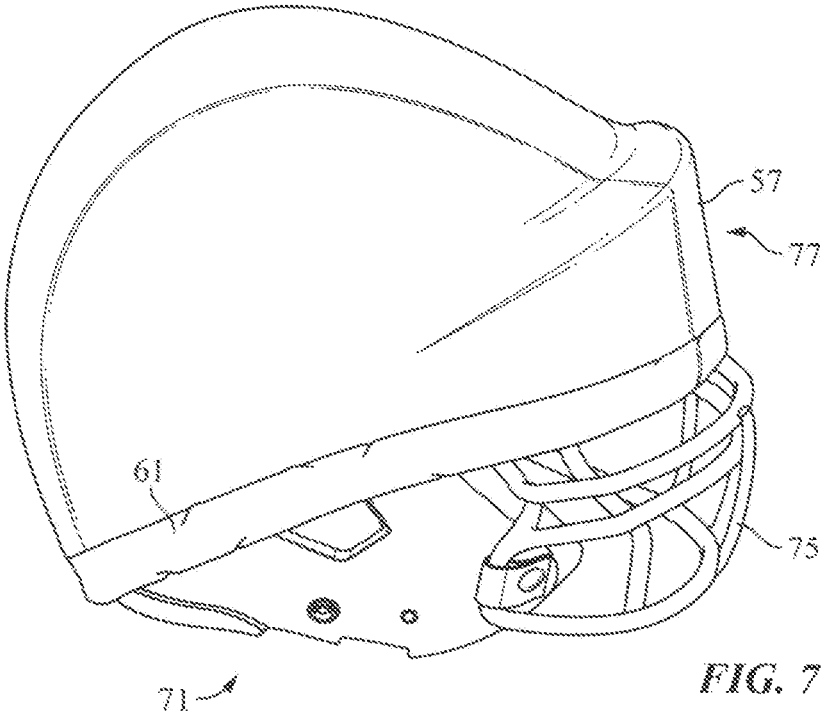
FIG. 7 is a side view of a football helmet with an embodiment of the helmet cover in the down or deployed position.

FIG. 7 is a side view of helmet 71 that shows helmet cover 51 in a deployed or lowered position 77. In the deployed position visor insert 57 is pulled down over the top of face mask 75. Elastic strap or band 61 expands to allow visor 57 to be moved to the deployed position 77.

Figure 9:
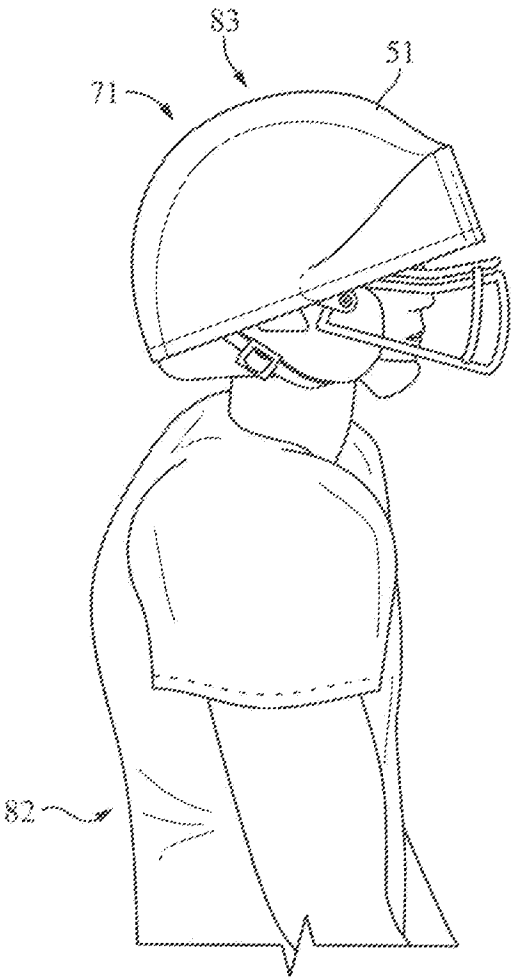
FIG. 9 is a side view of the helmeted football player with helmet cove in the deployed or down position.
Figure 8:
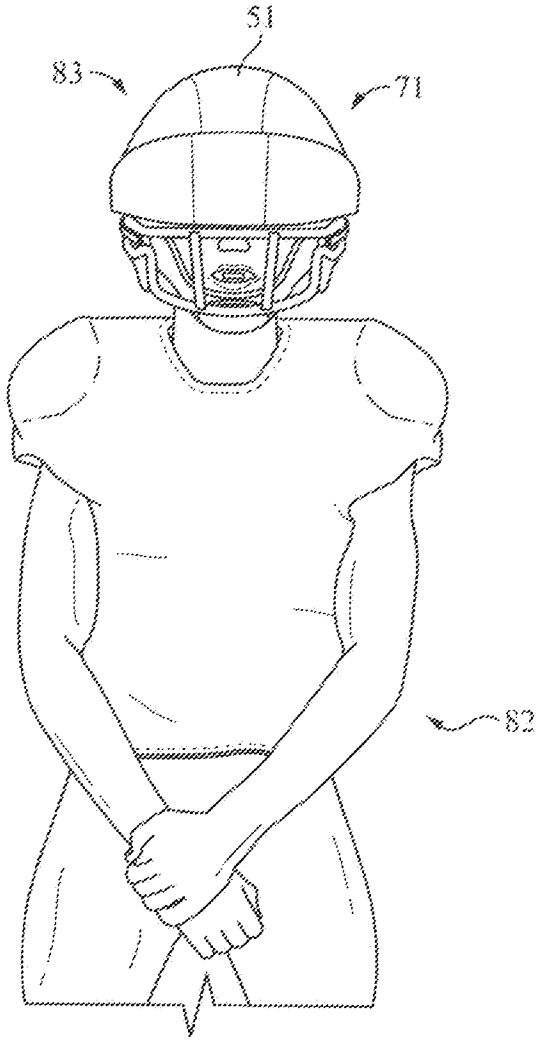
FIG. 8 is a front view of the helmeted football player with helmet cover in the deployed or down position.

FIG. 8 is a front view of a football played 82 wearing helmet 71 with helmet cover 51 in the down or deployed position 83. As can be seen the players vision or field of view is obstructed to the point he will need to raise his head to get a clear field of view in front of him. FIG. 9 is a side view the football player 82 with helmet cover 51 in the deployed or down position 83. As can be seen also from FIG. 9 player 82 wilt be forced to raise his head when practicing which as noted above reinforces proper positioning of the head by the player when tackling, blocking or checking.

Figure 11:
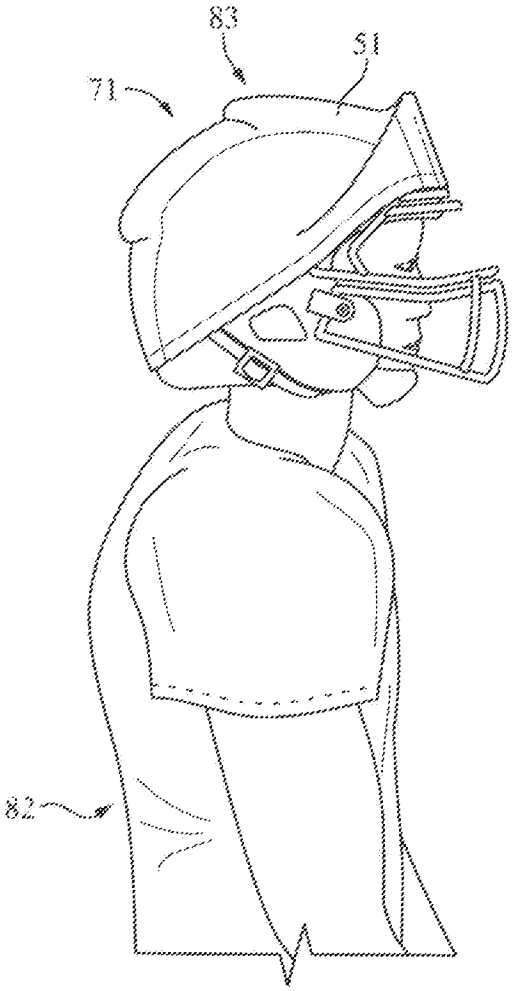
FIG. 11 is a side view of the helmeted football played wearing with helmet cover in the up or un-deployed position.
Figure 10:
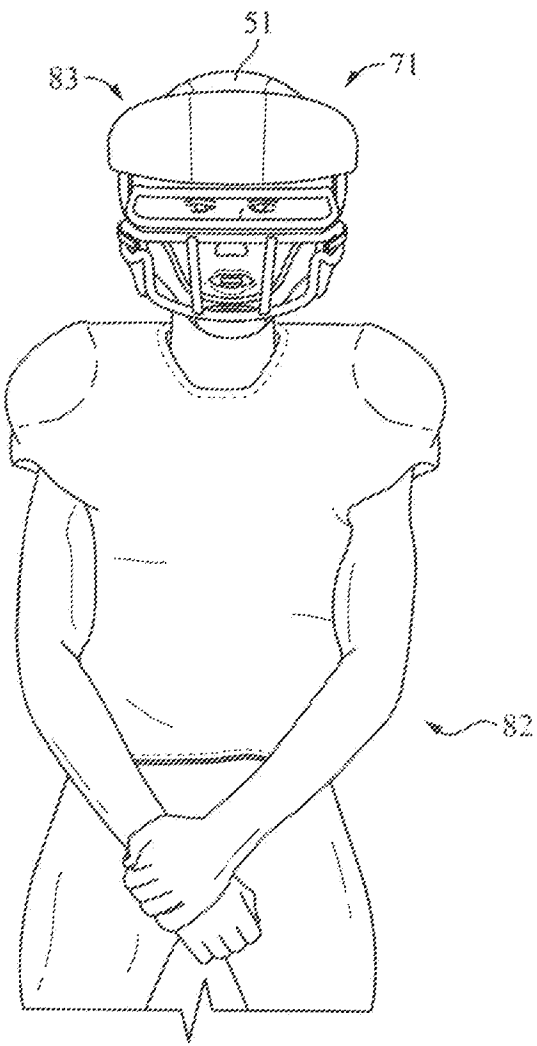
FIG. 10 is a front view of a helmeted football played with helmet cove in the up or un-deployed position.

FIG. 10 is a front view of a helmeted football player 82 with training cap or helmet cover 51 in the up or un-deployed position 84. In this position as noted above the player is ready to use cap 51 in blocking or tackling training. FIG. 11 is a side view of football player 82 with cap 51 in the up or un-deployed position 84. In FIG. 11 another front view of football player 82 has cap 101 in the up or un-deployed position 84, where the cap does not obstruct his field of view. Labeling 301 FIG. 29 could or would be provided with instructions for use of the cap by: positioning the cap on a protective helmet during use of the helmet by a player in a non-view obstructing position such as that depicted in FIGS. 10 and 11; and then moving the cap to a view obstructing position for training purposes to teach the wearer to keep his or her head up as depicted in FIGS. 8 and 9.

Figure 12:
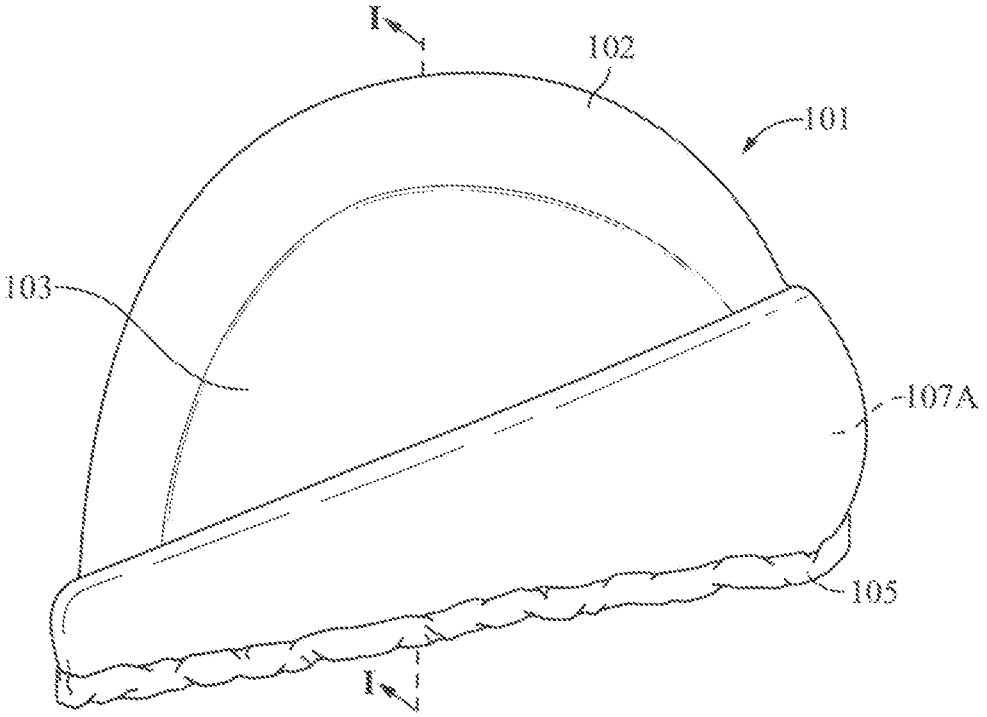
FIG. 12 is a side view of another embodiment of the helmet cap of the present invention.
Figure 13:
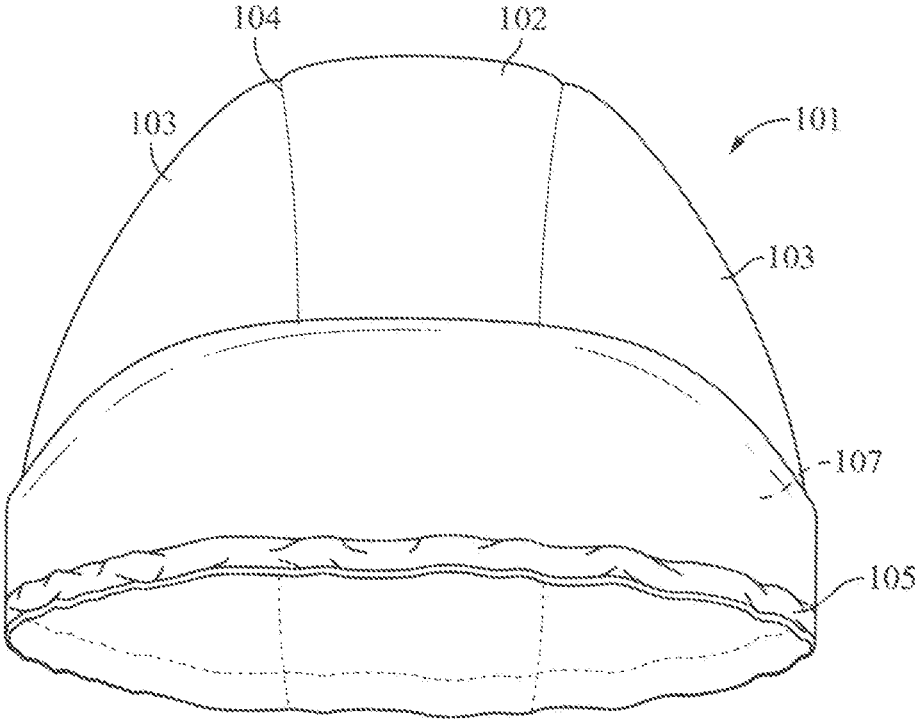
FIG. 13 is a front or anterior view of the helmet cap of FIG. 12.

FIGS. 12 and 13 depict another non-limiting exemplary embodiment of a football helmet cover 101 for use as a tackling training aid. Helmet cover 101 may be comprised of a single piece of material, or may include as depicted a central portion 102 which when placed on a football helmet extends from the front to the rear of the football helmet, center portion has connected to it two or more side panels 103 by suitable stitching 104 which will enclose the dome shaped portion of the football helmet. An insert or visor is sewn in or placed is positioned in a pocket at 107A, found in the inside front of football helmet cover 101. An elastic portion or band 105 passes around the free edge of the cover 101 to enhance the ability of the cover to maintain its connection to the football helmet. By way of non-limiting example, materials from which the cover 101 manufactured from various resilient stretchable materials including nylon, spandex or any similar textile which can endure stretching and retain its original shape. The material from which the cover 101 is manufactured can vary in color to thereby identifying different individuals on the field.

Figure 14:
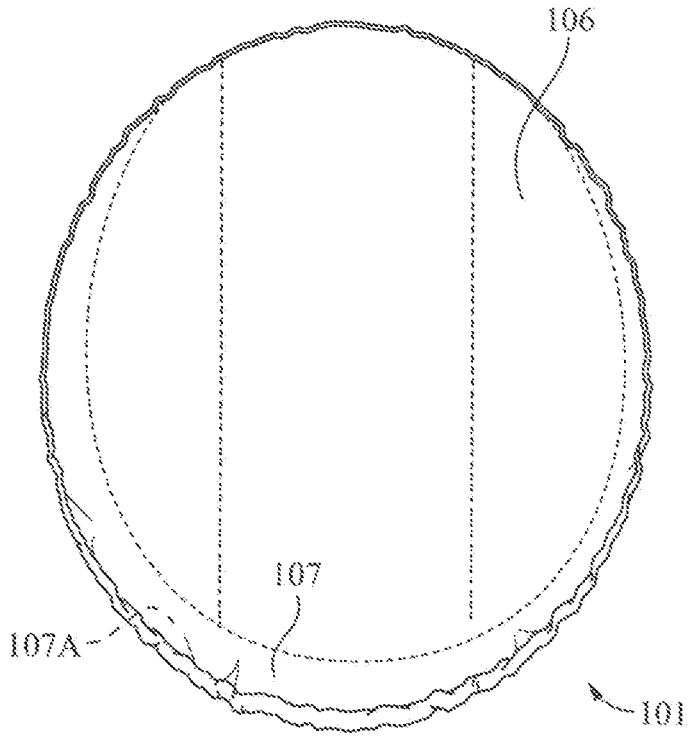
FIG. 14 is a bottom view of the helmet cap of FIG. 12.
Figure 15:
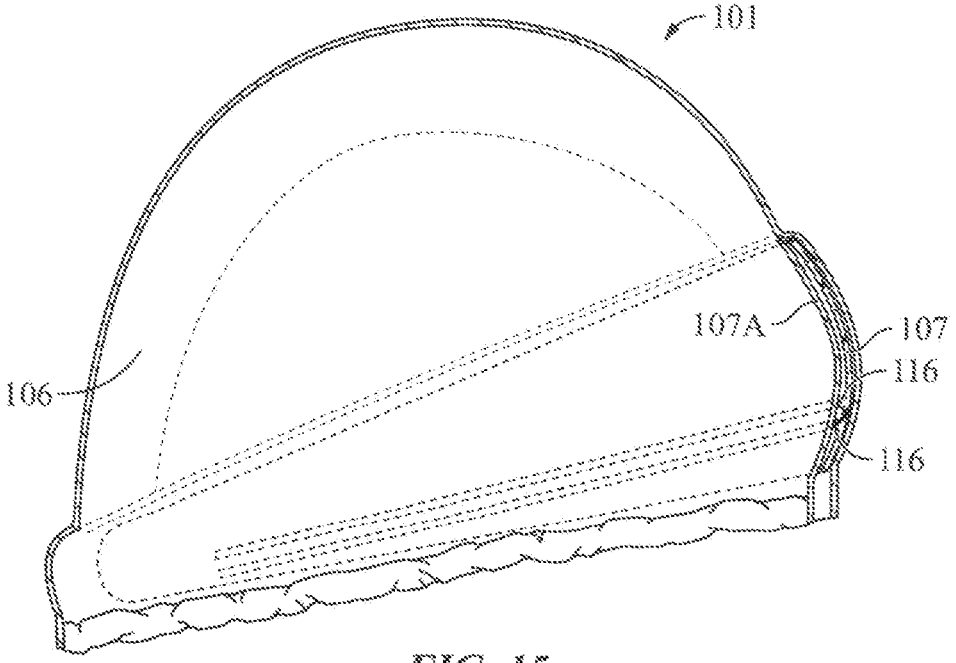
FIG. 15 is a cross sectional view along line I-I of FIG. 12.

FIG. 14 is an inferior or bottom view of football helmet cover 101 for use as a tackling training aid. The inner portion of the cover 101 in this variation includes a lining 106 that will increase the coefficient of friction to decrease the likelihood of the cover 101 being removed accidently or unexpectedly during use. As noted above located on either the inner or outer portion of the anterior aspect of the cover 101 is a semicircular or similarly shaped insert 107 manufactured from a rubber, plastic, polyethylene, polypropylene or a similar type of material that is rigid but also flexible and durable enough to withstand impact forces without deformation. Shown in FIG. 15 is a cross-sectional view along line Hof FIG. 12 of the embodiment of a football helmet cover 101 for use as a tackling training aid. As shown in FIG. 15, insert or visor 107 is located in the anterior aspect of the helmet cover 101 and may or may be sewn into the cover or placed in a pocket 107A sized to accept insert-visor 107 and securely hold it.

Figure 16:
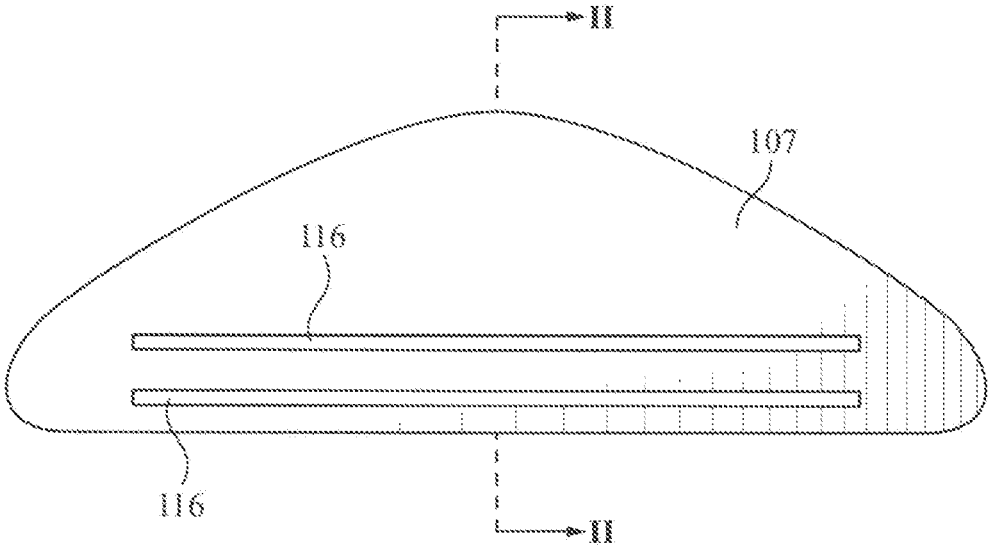
FIG. 16 is a view of the back or posterior of the visor-insert depicted in FIG. 14.
Figure 17:
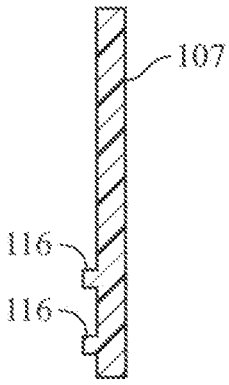
FIG. 17 is a cross sectional view of insert FIG. 16 along lines II-II.

FIG. 16 depicts a view of the rear or back of insert-visor 107. In this variation of insert 107 has a retaining lip of one or more ridges 116 that will assist in the training cap 101 maintaining an appropriate position on the football face-mask. FIG. 17 a cross sectional view along line II-II of FIG. 16; ridges 116 are visible in FIG. 17. Alternatively ridges 116 could be groves which catch on the face mask to hold visor 107 in place when it is placed in the down position.

Figure 18:
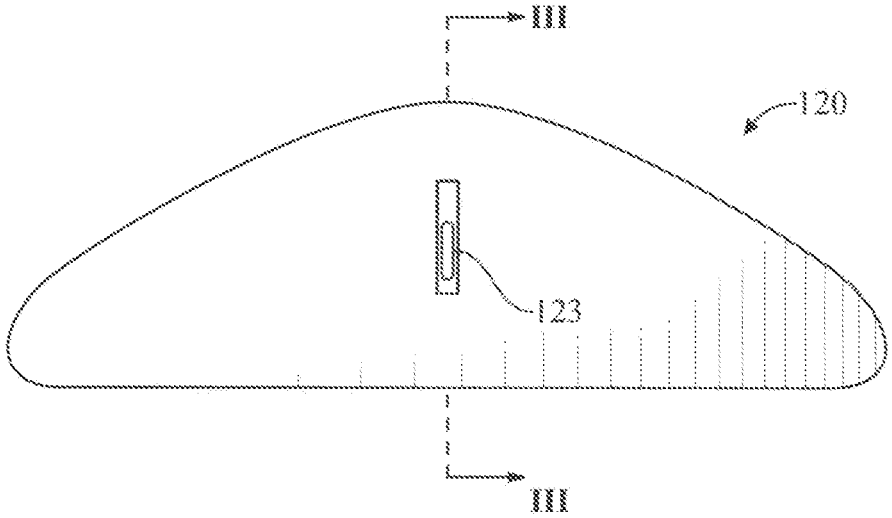
FIG. 18 is a font view of another embodiment of the insert-visor of the present invention.
Figure 19:
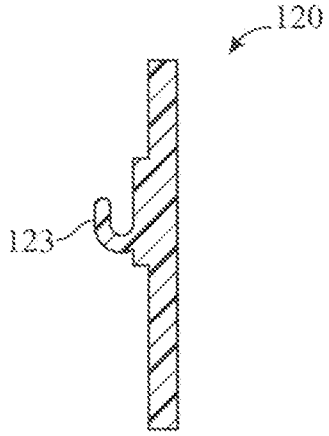
FIG. 19 is across sectional view the embodiment of the insert-visor depicted in FIG. 18 along line III-III of FIG. 18.

FIG. 18 depicts a view of the back or posterior side another variation of the visor-insert 120. In this variation a retaining lip such as a hook 123 is positioned at the middle of visor 120 which can hook onto a portion of a face mask to hold cap 101 in the down or deployed position for tackling/blocking training. FIG. 19 is a cross sectional view of visor 120 along line III-III of FIG. 18. As depicted in FIGS. 18 and 19 the hook 123 is positioned at the center of the inside surface of the visor 120.

Hook 123 and projections 116 detachably connect to a portion of the helmet or to a portion of a face guard attached to the helmet to detachably hold the visor and thus the training cap in place in the down or deployed position when the cap is being used for training purposes. Referring back to FIG. 6 if hook 123 or projections 116 formed part of visor 57 than when cap 51 is pulled down into the deployed position than hook 123 or projections 116 would catch onto bar 76 or 78 of facemask 75.

Figure 20:
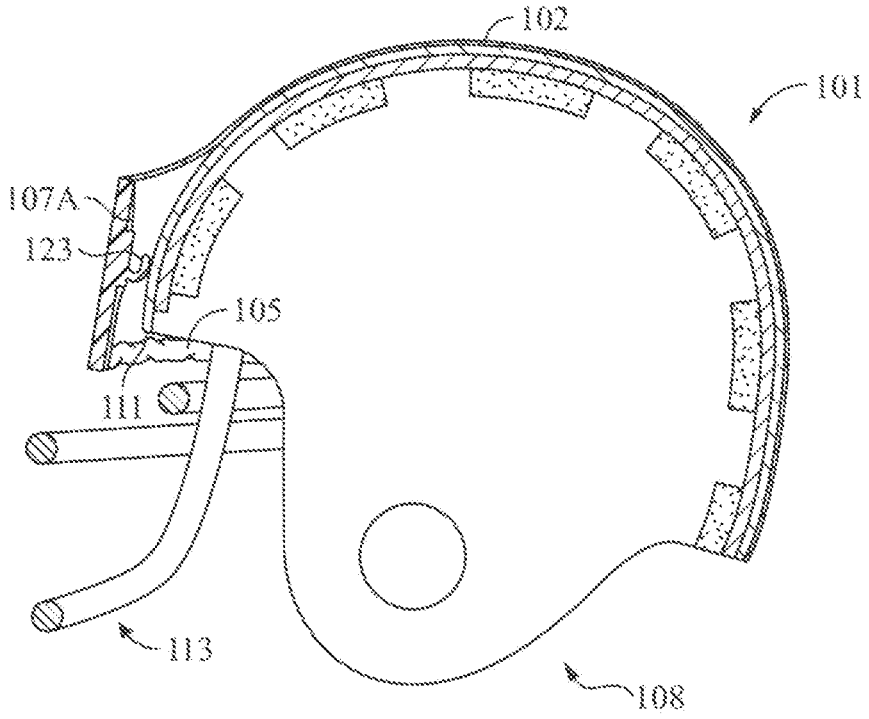
FIG. 20 is a cross-sectional side view of the interior of a football helmet, as if it were cut down the middle, with an embodiment of the eye screen cap of the present invention on the helmet in the down or deployed position.
Figure 21:
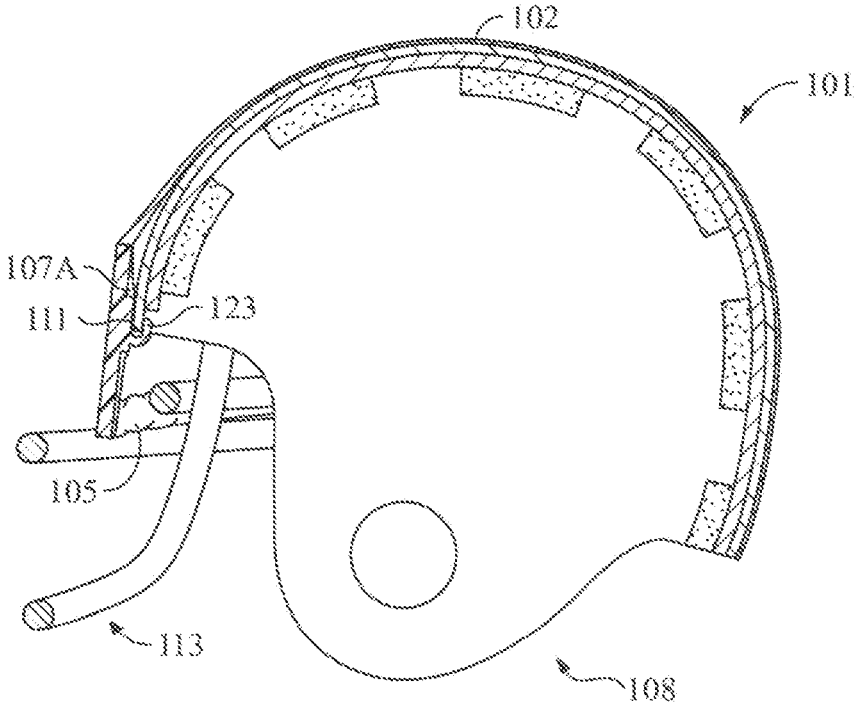
FIG. 21 is the helmet depicted in FIG. 20 with the eye screen cap in the up or un-deployed position for training purposes.

FIG. 20 is a cross-sectional side view of a football helmet (as if t were cut down the middle) showing the interior of helmet 108. It is similar to the view indicated by lines IV-IV of FIG. 7 as if the helmet is cut in half. However, helmet 108 of FIG. 20 does not have the upper face mask cross bars 76 and 78 of helmet 71 in FIGS. 6 and 7. In FIG. 20 training cap 101 is in the down or deployed position. In FIG. 20 upper rim or edge 111 of helmet 108 has hook 123 detachably connected to rim or edge 111. This holds visor insert 120 detachably but securely connected to helmet rim 111 in the down of deployed position. Thus, hook 123 keeps training cap 101 in the deployed or down position during use. In FIG. 21 helmet cover 101 has been moved to the up or un-deployed position. It should be noted that the hook 123. FIG. 18 on visor insert 120 can work equally well and detectably but securely connect to face mask cross bars 76 and 78 of the helmet depicted in FIGS. 6 and 7. Additionally, the variation of the visor 107 depicted in FIGS. 16 and 17 can also provide a detachable but secure mechanism for holding the training cap in the down or deployed position during use. Ridges 116 on protective insert 107 will hold it on the edge of the helmet of upper face bars 76 and 78 of FIG. 7.

Figure 22:
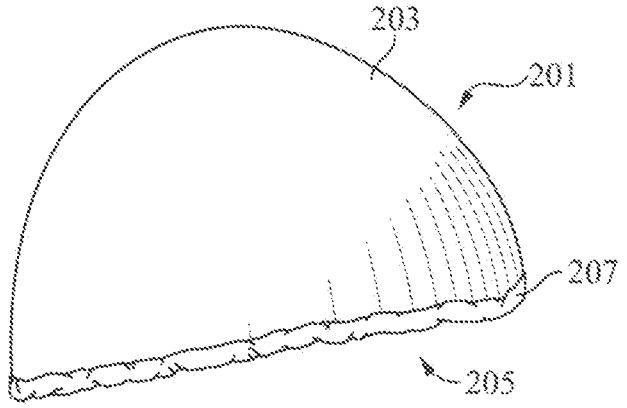
FIG. 22 is a side view of another embodiment of the training cap or cover of the present invention which does not have a visor-insert.
Figure 23:
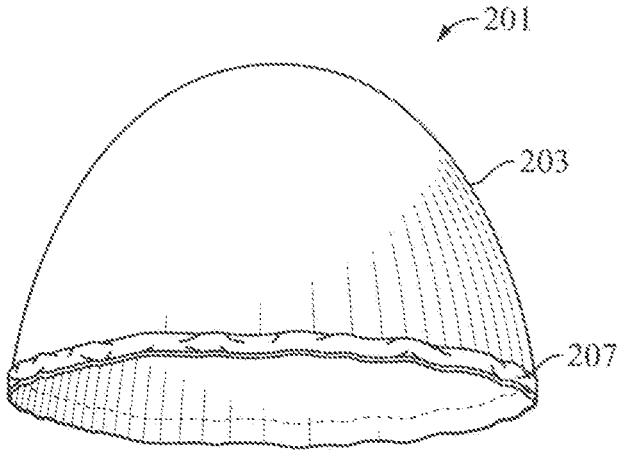
FIG. 23 is a front view of the embodiment of the training cap of FIG. 22.
Figure 24:
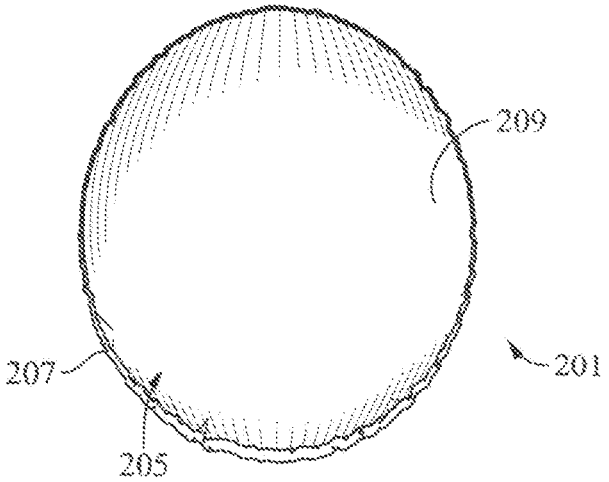
FIG. 24 is a bottom view of the embodiment of the training cap of FIG. 22.

FIGS. 22, 23 and 24 depict an embodiment of the eye screen cap of the present invention that does not utilize a visor insert. FIGS. 22 and 23 are side and front views of another embodiment 201 of the helmet training cover or eye screen cover of the present invention. Cap 201 is made of, one piece of fabric 203 with an elastic band 207 around its bottom opening 205. FIG. 24 is a view of the bottom opening 205 of cap 201. Elastic band 207 extends around the entire opening. The interior surface of cap 201 is covered by a lining 209 of a material that has an increased coefficient of friction to decrease the likelihood of cap 201 being unexpectedly or accidentally removed during use. Although embodiment 201 is made from a single piece of fabric on its outside, it just as easily have been made from three pieces of fabric as the other embodiments described above. By way of non-limiting example, materials from which the cap 201 can be fabricated from include but are not limited to nylon, spandex of similar material or textile which can endure stretching and rugged use and still retain their shape and durability. The material that cap is made of can also be colored for various purposes including of identifying different individuals on the field.

Figure 25:
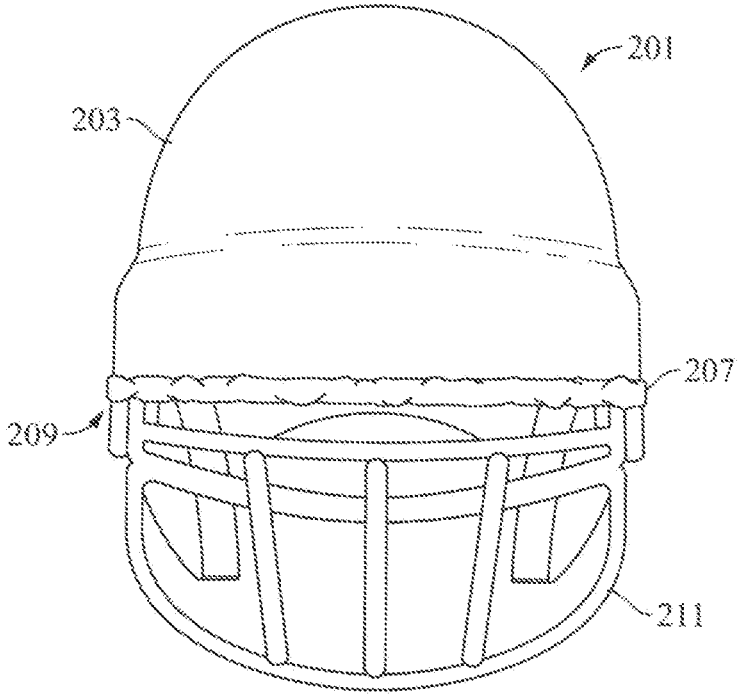
FIG. 25 is a front view of the embodiment of the eye screen training cap depicted in FIGS. 22 to 23 in the down or deployed position.
Figure 26:
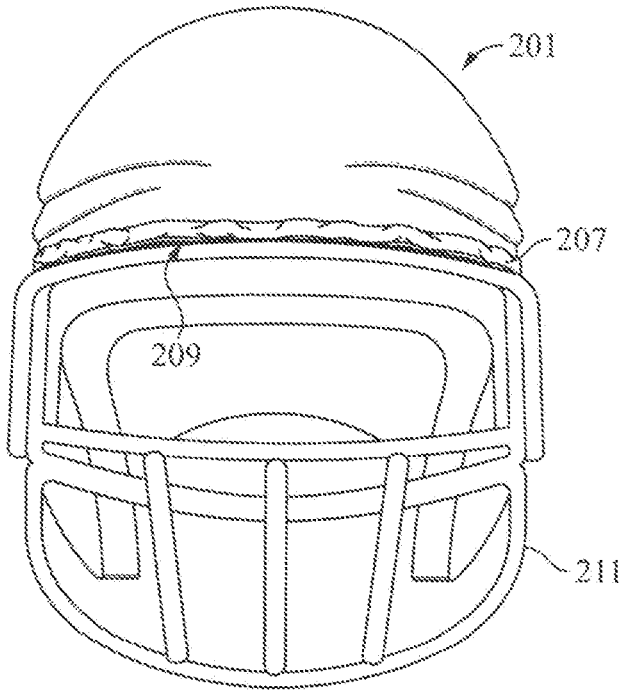
FIG. 26 is a front of the helmet of FIG. 25 with the helmet eye screen cover in the up or un-deployed position.
Figure 27:
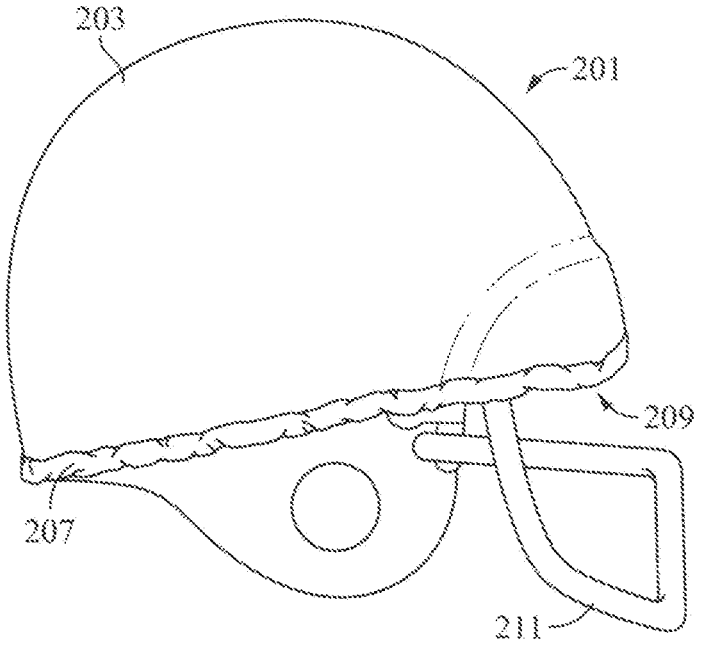
FIG. 27 is a side view of a helmet with the embodiment of the eye screen training cap depicted in FIGS. 22 to 23 in the down or deployed position.
Figure 28:
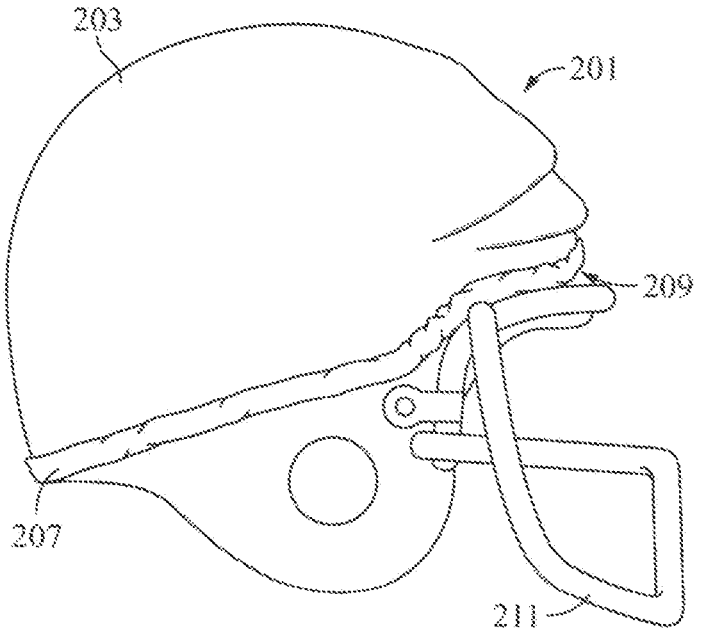
FIG. 28 is a side of the helmet of FIG. 27 with the helmet eye screen cover in the up or un-deployed position.

FIG. 25 is a front view of a helmet with training cap 201 in the down or deployed position on helmet 209. FIG. 26 is a front view of helmet 209 with training cap 201 in the up or un-deployed or up position. FIG. 27 is a side view of helmet 209 with cap 201 in the down or deployed position FIG. 28 is a side view of helmet 209 with cap 201 in the up or un-deployed position. In FIGS. 25 and 28 the part of elastic band 207 that is at the front of helmet 209 rests on the upper rim of the helmet or upper bar of face mask 211. Labeling could or would be provided with instructions for use of the cap by: positioning the cap on a protective helmet during use of the helmet by a player in a non-view obstructing position such as that depicted in FIGS. 26 and 28; and then moving the cap to a view obstructing position for training purposes to teach the wearer to keep his or her head up as depicted in FIGS. 25 and 27.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A vision obstruction cap for use with a football helmet to induce proper head and eye orientation when performing football tackling drills comprising:

a. a pliable cap that can be detachably but securely attached to a football helmet and upper facemask, having a front, a back and a peripheral edge defining an opening;

b. wherein when said pliable cap is attached to the football helmet and upper facemask of said pliable cap can be moved between:

i. a first position that obstructs a football helmet wearer's vision to thereby force the football helmet wearer to keep their head up when performing football tackling drills; and ii. a second position that does not obstruct the football helmet wearer's vision;

c. said pliable cap includes an embedded visor insert in a pocket formed on the inside of the peripheral edge from the front towards the back, and an elastic band around an inner peripheral edge of said opening of said pliable cap such that said embedded visor insert is a portion of said pliable cap that obstructs the football helmet wearer's view when said pliable cap is in said first position and said embedded visor insert allows the wearer wearing the football helmet with said pliable cap to move said pliable cap between said first position and said second position without taking said pliable cap off of the helmet; wherein said elastic band circles around the inner peripheral edge of the opening and has an increased coefficient of friction to thereby inhibit movement to hold said pliable cap and embedded visor insert in place in said first or second positions.

2. The vision obstruction cap of claim 1 wherein said pliable cap comprises a rectangular center panel and two semi-circular side panels.

3. The vision obstruction cap of claim 1 wherein said pliable cap is sized to fit over a football helmet and upper facemask by fabricating said pliable cap from a pliable stretchable material.

4. The vision obstruction cap of claim 3 wherein said pliable stretchable material is selected from a group consisting of: nylon, polyester, and spandex.

5. The vision obstruction cap of claim 1 wherein said pliable cap comprises a center panel and two side panels, wherein said center panel and said two side panels are secured together with stitching.

6. The vision obstruction cap of claim 1 wherein said visor insert is made of a pliable flexible semi-rigid material.

7. The vision obstruction cap of claim 6, wherein said visor insert made of the pliable flexible semi-rigid material is selected from a group consisting of plastic and polypropylene.

8. The vision obstruction cap of claim 1, further includes labeling providing instructions for use of said cap by: i. positioning said cap on a football helmet and facemask during use of the football helmet by a player in an obstructing position for training purposes to teach the player to keep his or her head up when performing blocking and tackling drills; and ii. moving the cap to a non-view obstructing position.

9. A method for training a wearer of a football helmet to properly orientate the wearers head when performing football blocking and tackling drills comprising the steps of:

a. providing a vision obstruction cap of claim 1 that can be detachably but securely attached to a football helmet and upper facemask;

b. positioning at a first position the cap securely but detachably on the football helmet in a position that obstructs the football helmet wearer's view to thereby force the helmet wearer to raise his or her head to a proper position when performing blocking and tackling drills;

c. moving the cap to a second position that does not obstruct the view of the football helmet wearer;

d. providing the pliable cap with an inner surface that circles around the inner peripheral edge for resisting movement of the cap when it is in either the first or second position.

10. The method of claim 9 whereas the visor insert would be closest to the upper facemask, and the visor insert in the pocket will contact the upper portion of the facemask and using the visor insert to move the cap by grasping said embedded visor insert and moving it up or down over the front of the facemask between the position that obstructs the view of the football helmet wearer and forces them to keep their head up while blocking and tackling to the position where the cap does not obstruct the football helmet wearer's vision.

11. The method of claim 10 including the step of making the visor insert from a pliable but rigid and durable material whereas the visor insert would be closest to the upper facemask, and the visor insert in the pocket will contact the upper portion of the facemask.

12. The method of claim 9 including the step of providing the elastic band sewed onto the said pliable cap along the inner peripheral edge near the opening that allows the cap to be stretched over the helmet and upper facemask to hold said pliable cap in the desired position and for providing a layer that has an increased coefficient of friction to thereby inhibit movement of the said cap on the football helmet and upper facemask.

* * * * *